US010455905B1

(12) United States Patent
Baker et al.

(10) Patent No.: US 10,455,905 B1
(45) Date of Patent: Oct. 29, 2019

(54) INTERCHANGEABLE ACCESSORY ASSEMBLY AND METHOD OF USE

(71) Applicant: HOME WITH ALEXANDRA INC., Fort Lauderdale, FL (US)

(72) Inventors: Alexandra Baker, Cooper City, FL (US); Troy Baker, Cooper City, FL (US)

( * ) Notice: Subject to any disclaimer, the term of this patent is extended or adjusted under 35 U.S.C. 154(b) by 65 days.

(21) Appl. No.: 15/913,594

(22) Filed: Mar. 6, 2018

Related U.S. Application Data

(60) Provisional application No. 62/467,847, filed on Mar. 7, 2017.

(51) Int. Cl.
*A44B 99/00* (2010.01)
*A45C 13/00* (2006.01)

(52) U.S. Cl.
CPC ..... *A44B 99/00* (2013.01); *A45C 13/001* (2013.01); *A44D 2203/00* (2013.01)

(58) Field of Classification Search
CPC ..... Y10T 24/32; Y10T 24/13; Y10T 24/1306; A45C 13/001; A44D 2203/00; A44B 99/00
See application file for complete search history.

(56) References Cited

U.S. PATENT DOCUMENTS 3,141,216 A * 7/1964 Haskell ..... A41F 1/002 24/303

OTHER PUBLICATIONS

Better Homes and Gardens, Magnetic Lamp Shade Embellishment, Product No. BH43-020-499-39, photographs taken on Aug. 3, 2015, pp. 1-7.

* cited by examiner

*Primary Examiner* — Robert Sandy
(74) *Attorney, Agent, or Firm* — The Concept Law Group, PA; Scott D. Smiley

(57) ABSTRACT

An interchangeable accessory assembly that is operably configured to be selectively removably coupled to a fashionable item, the fashionable item having an exterior side opposite an interior side, the interchangeable accessory assembly comprising an anchor shell; a first magnetic member disposed at least partially within the anchor shell; and an accessory selectively removably mechanically couplable to the anchor shell. The anchor shell includes a first tapered portion opposite a second tapered portion, the first tapered portion and the second tapered portion defining a smooth outer surface having a length. The accessory includes a coupling side having a second magnetic member and a decorative side opposite the coupling side. The interchangeable accessory assembly is operably configured such that the first magnetic member and the second magnetic member mechanically couple and have a magnetic strength sufficient to couple each of the anchor shell and the accessory to the fashionable item.

20 Claims, 14 Drawing Sheets

100

700

100

INTERCHANGEABLE ACCESSORY ASSEMBLY AND METHOD OF USE

This application claims priority to U.S. Provisional Patent Application No. 62/467,847, filed Mar. 7, 2017, the entirety of which is incorporated by reference.

FIELD OF THE INVENTION

The present invention relates generally to interchangeable accessories, and, more particularly, relates to an interchangeable accessory assembly for the efficient customization of fashionable items, such as bags, purses, frames, pillows, sheets, blankets, lampshades, items of apparel, and the like.

BACKGROUND OF THE INVENTION

Many people choose to purchase a particular item due to the aesthetic and fashionable qualities of the item. This is particularly true for fashionable and home decor items, such as bags, purses, frames, pillows, sheets, blankets, lampshades, items of apparel, and more. Professional designers offer high-end items with unique designs based on aesthetic and fashionable trends, often at a very high cost to a consumer. Even when a consumer purchases an item designed to be fashionable, the consumer often feels the desire to customize the item, making it a truly unique design with the consumer's creative contribution.

A consumer that wishes to customize an item typically must permanently alter or damage the item. This is because the consumer is forced to stitch, adhere, screw, or create a hole to pin the customization to the item, thereby permanently altering and/or damaging the item in some way. Moreover, stitches, adhesives, and holes have the potential to destroy the item, which can make it very difficult for the consumer to resell or return the item to recover the original amount paid for the item. Further, by installing a permanent customization to the item, the consumer lacks the ability to easily and efficiently change the customization, such as by moving the customization to another portion of the item, or by installing an entirely new customization.

Magnetic customization devices currently exist, but they are not widely used. In order to minimize cost and reduce the space needed, the devices tend to be small. Moreover, while the devices may include magnet assemblies, the magnets used in the devices tend to be weak, due to the small size of the devices. If larger and/or stronger magnets are used, the resulting structure sticks out from the surfaces to which it is attached. As a result, the devices are easy to hit or bump and are easily dislodged and detached from fashionable items. In particular, this is a problem when the device is used in conjunction with a purse or a bag, because a user may easily detach the back of the device from the purse or bag by reaching into the purse or bag to retrieve a different item, such as a set of keys or a cellular phone. When the back of the device detaches, the customization detaches from the fashionable item, potentially causing the customization to fall and become lost, damaged, or broken. This is a particular problem when expensive customizations are used, such as jewelry or artistic pieces. Moreover, larger and/or stronger magnets may create a magnetic field that can be damaging to items housed within a bag or purse, such as keys, cellular phones, and credit cards.

Therefore, a need exists to overcome the problems with the prior art as discussed above.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
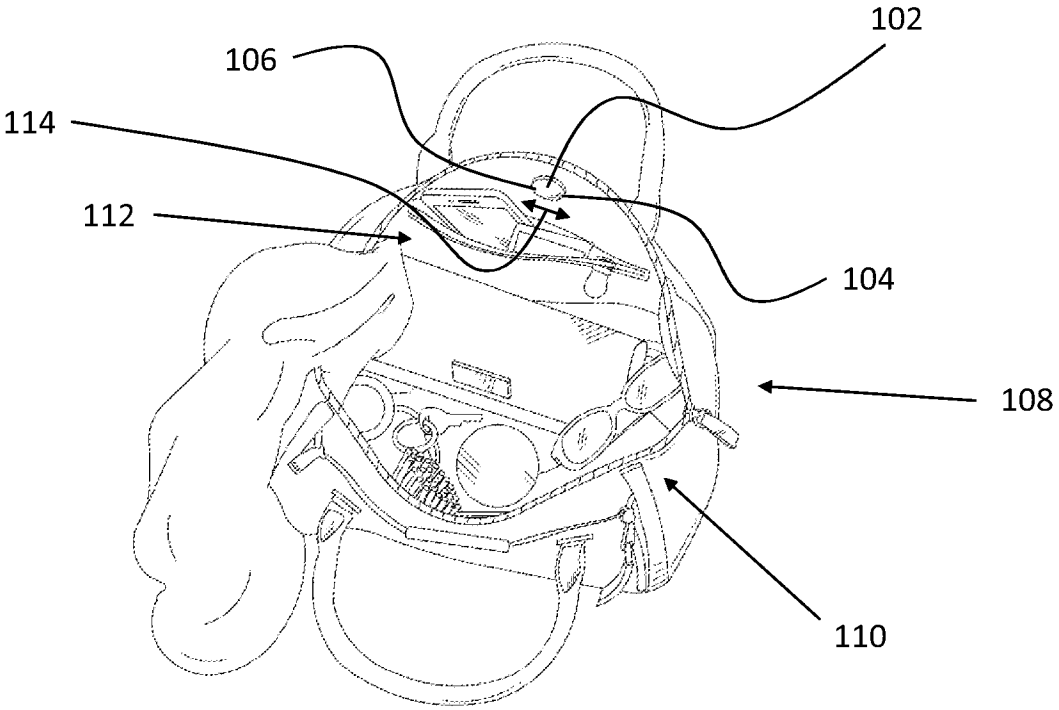
FIG. 1 is a perspective downward-facing view of an interchangeable accessory assembly and method of use.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

Although the invention is illustrated and described herein as embodied in an interchangeable accessory assembly and method of use, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Some detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure.

Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of an anchor shell from a first tapered portion to a second tapered portion.

The present invention provides a novel and efficient interchangeable accessory assembly and method of use. Embodiments of the invention provide a user with the ability to customize a fashionable item, including a fashionable item already owned by the user. In addition, embodiments of the invention provide the user with the ability to interchange various customizations, without permanently attaching the customization to the fashionable item, and without damaging the fashionable item.

Figures 3, 4:
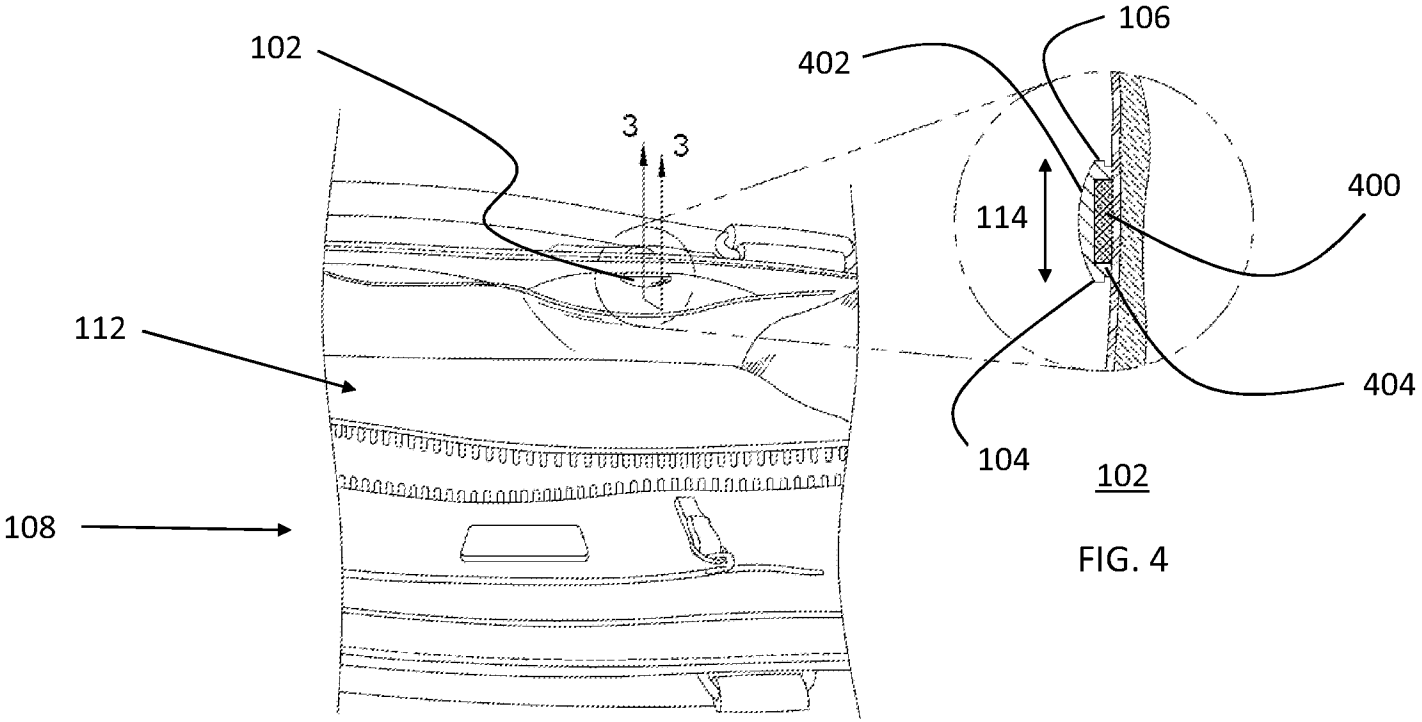
FIG. 3 is an elevational close-up view of the anchor shell of the interchangeable accessory assembly of FIG. 1, in accordance with one embodiment of the present invention.
FIG. 4 is an elevational cross-sectional view of the interchangeable accessory assembly of FIG. 1 along line 3-3 of FIG. 3, in accordance with one embodiment of the present invention.
Figure 7:
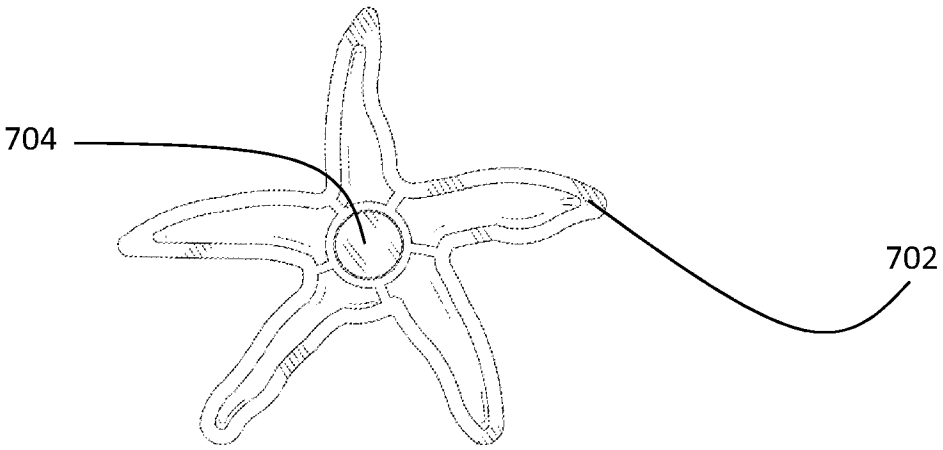
FIG. 7 is a perspective view of the accessory of the interchangeable accessory assembly of FIG. 1, in accordance with one embodiment of the present invention.

Referring now to FIGS. 1, 4, and 7, one embodiment of the present invention is shown. FIGS. 1, 4, and 7 show several advantageous features of the present invention, but, as will be described below, the invention can be provided in several shapes, sizes, combinations of features and components, and varying numbers and functions of the components. The first example of an interchangeable accessory assembly 100 and method of use, as shown in FIGS. 1, 4, and 7, includes an anchor shell 102, shown in FIG. 1; a first magnetic member 400, shown in FIG. 4; and an accessory 700, shown in FIG. 7. The interchangeable accessory assembly 100 is operably configured to be selectively removably coupled to a fashionable item 108, as shown in FIG. 1. As used herein, "fashionable item" includes, but is not limited to, a bag, a purse, a clutch, a tote, a frame, a pillow, a sheet, a blanket, a lampshade, an item of apparel, home decor items and accessories, and the like. As shown in FIG. 1, in a preferred embodiment, the fashionable item 108 may include an exterior side 110 and an interior side 112 opposite the exterior side 110.

Figure 2:
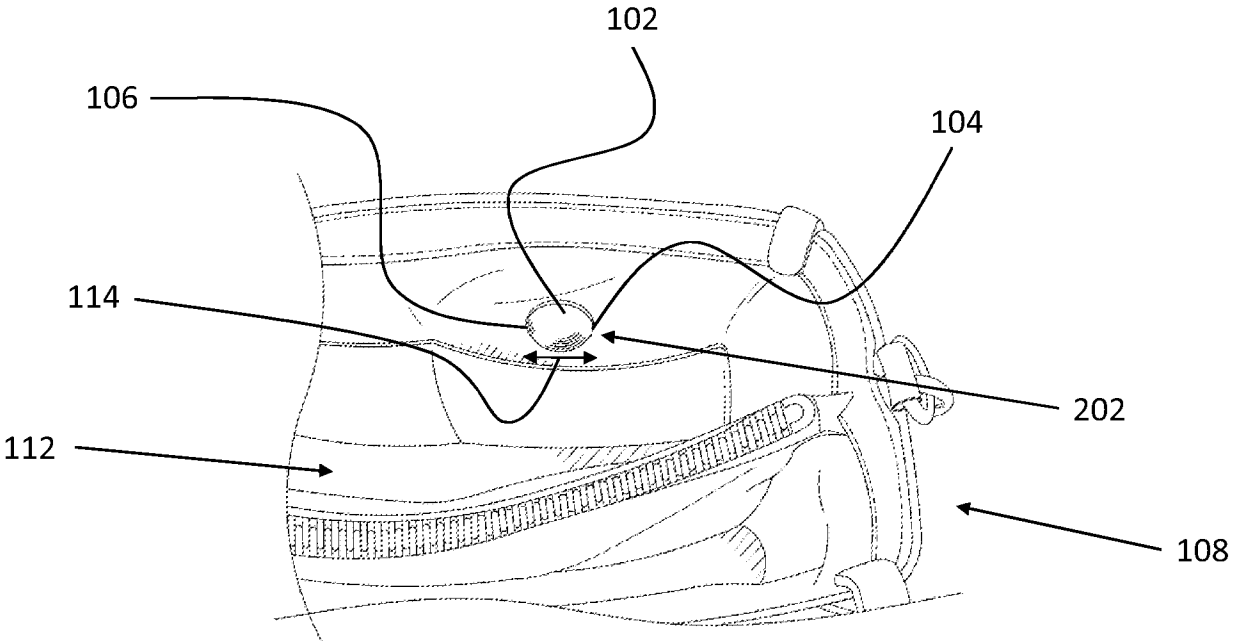
FIG. 2 is a perspective close-up view of the anchor shell of the interchangeable accessory assembly of FIG. 1, in accordance with one embodiment of the present invention.

Referring particularly to FIG. 1, the anchor shell 102 is shown in detail. FIG. 1 depicts the interchangeable accessory assembly 100 used in conjunction with the fashionable item 108, and particularly shows the anchor shell 102 coupled to the fashionable item 108. The anchor shell 102 may be operably configured to be selectively removably coupled to the interior side 112 of the fashionable item 108. As used herein, "interior side" means the inner portion of a bag, purse, pillow, and other items of the like, in which items may be concealed and stored, as well as the back side of a frame, such as a picture frame. Close-up views of the anchor shell 102 coupled to the interior side 112 of the fashionable item 108 are shown in FIGS. 2-3.

Still referring to FIG. 1, in one embodiment, the anchor shell 102 may include a first tapered portion 104. The anchor shell 102 may also include a second tapered portion 106 opposite the first tapered portion 104, with the first tapered portion 104 and the second tapered portion 106 defining an outer surface 402 having a length 114, which is best shown in FIG. 4, representing a close-up cross-sectional view of the anchor shell 102. As used herein, "tapered" means becoming progressively narrowed and gradually decreasing in width, for example, decreasing in width from the apex of the anchor shell 102 to the first tapered portion 104, and from the center of the anchor shell 102 to the second tapered portion 106, such that the outer surface 402 of the anchor shell 102 is smooth. In one embodiment, the smooth outer surface 402 of the anchor shell 102 and the interior side of the fashionable item 108 make a substantially continuous surface area 202 (as seen in FIG. 2). As used herein, "substantially continuous surface area" means a transition with a low coefficient of friction, such that contact with keys or other common items inside of the fashionable item 108 will not easily dislodge the interchangeable accessory assembly 100. Said another way, the substantially continuous surface area 202 formed by the first tapered portion 104, the second tapered portion 106, and the fashionable item 108 advantageously provides for a user's hand to translate along the outer surface 402, as opposed to colliding with the anchor shell 102, as would occur if the anchor shell 102 projected out at a sharp angle with respect to the fashionable item 108. Moreover, the anchor shell 102 cannot be easily dislodged from the fashionable item 108 when a user reaches into the fashionable item 108 to obtain an item, such as a key, wallet, pair of sunglasses, cosmetic container, cellular phone, and the like.

The anchor shell 102 may be elongated from the first tapered portion 104 to the second tapered portion 106, such that the length 114 of the anchor shell 102 is greater than a width of the anchor shell 102, such as at the apex of the anchor shell 102. As such, in one embodiment, the anchor shell 102 may be substantially hemispheric in shape. In other embodiments, the anchor shell 102 may be shapes other than hemispheric, including, but not limited to, triangular, rectangular, quadrangular, and the like.

Figure 5:
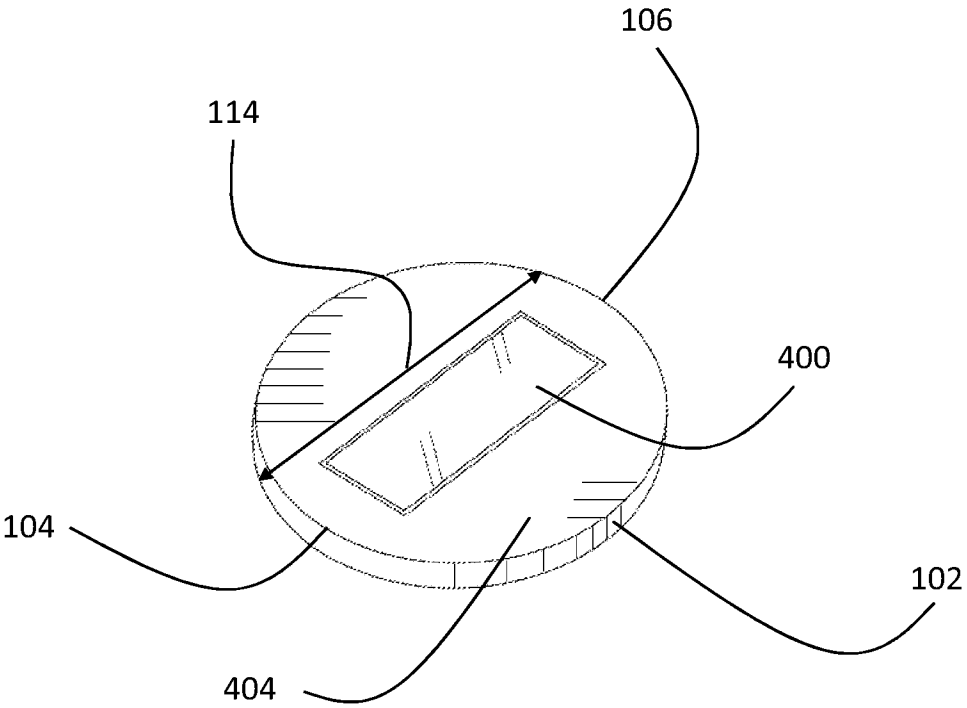
FIG. 5 is a perspective view of the anchor shell and the first magnetic member of the interchangeable accessory assembly of FIG. 1, in accordance with one embodiment of the present invention.

Referring now to FIG. 4, which is a cross-sectional view of the anchor shell 102 along section line 3-3 of FIG. 3, and FIG. 5, which is a perspective view of the anchor shell 102, the anchor shell 102 may include a first magnetic member 400. The first magnetic member 400 may be disposed at least partially within the anchor shell 102, such that the anchor shell 102 may provide a barrier that prevents the magnetic field of the first magnetic member 400 from damaging items housed within the fashionable item 108, such as a key, a cellular phone, a credit card, and the like. In one embodiment, at least a portion of the first magnetic member 400 may extend from the anchor shell 102, such that at least a portion of the first magnetic member 400 is disposed in the ambient environment surrounding the anchor shell 102, as opposed to being flush with the anchor shell 102. In another embodiment, the first magnetic member 400 may be disposed completely within the anchor shell 102, such that no portion of the first magnetic member 400 may extend from the anchor shell 102. As used herein, "disposed completely within" means that no portion of the first magnetic member 400 extends from the anchor shell 102, but that the first magnetic member 400 is not housed within the anchor shell 102. Said another way, "disposed completely within" means that at least a portion of the first magnetic member 400 is exposed to the ambient environment surrounding the anchor shell 102, while no portion of the first magnetic member 400 extends from the anchor shell 102 and into the ambient environment surrounding the anchor shell 102. In a further embodiment, the first magnetic member 400 may be disposed substantially flush with an inner surface 404 of the anchor shell 102, such that the first magnetic member 400 and the inner surface 404 of the anchor shell 102 are substantially continuous and co-planar, such as is shown in FIGS. 4-5. In one embodiment, the first magnetic member 400 may substantially span from the first tapered portion 104 to the second tapered portion 106. In another embodiment, the first magnetic member 400 may span at least 70% of the length 114 defined by the first tapered portion 104 and the second tapered portion 106, such as is shown in FIGS. 4-5. In a further embodiment, the first magnetic member 400 may span less than 70% but more than 10% of the length 114 defined by the first tapered portion 104 and the second tapered portion 106.

Figure 6:
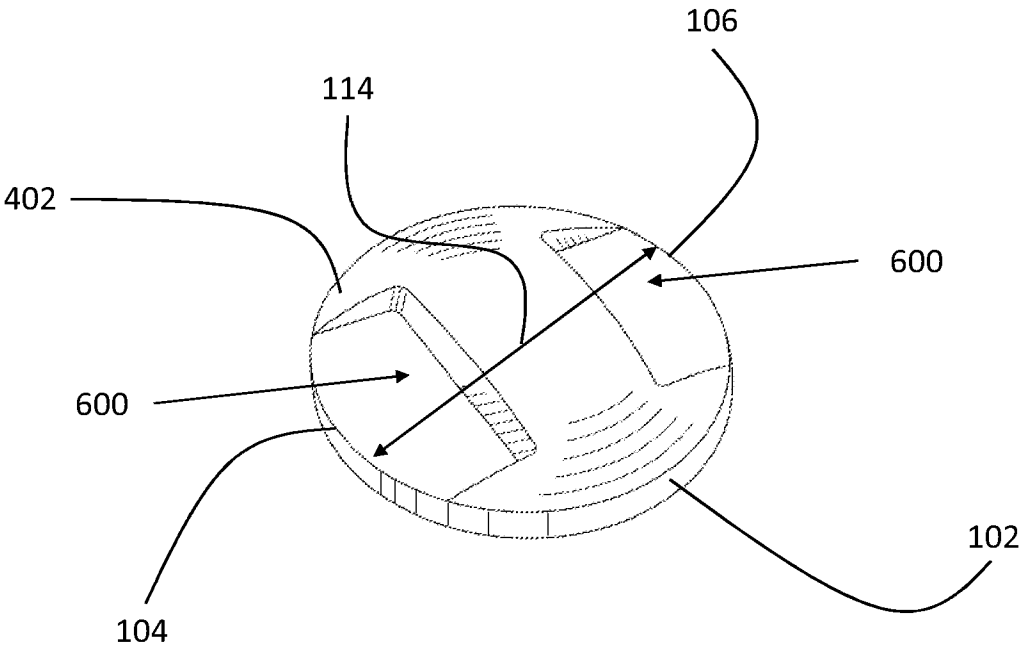
FIG. 6 is a perspective view of the anchor shell of the interchangeable accessory assembly of FIG. 1, in accordance with one embodiment of the present invention.

Referring now to FIG. 6, with brief reference to FIG. 1, in one embodiment, the outer surface 402 of the anchor shell 102 may define at least one indentation 600 that advantageously provides a user with the ability to easily and efficiently grip and maneuver and/or remove the anchor shell 102 from the interior side 112 of the fashionable item 108. For example, the at least one indentation 600 would allow the user to grip the anchor shell 102 with, for example, the user's thumb and/or index finger.

Figure 8:
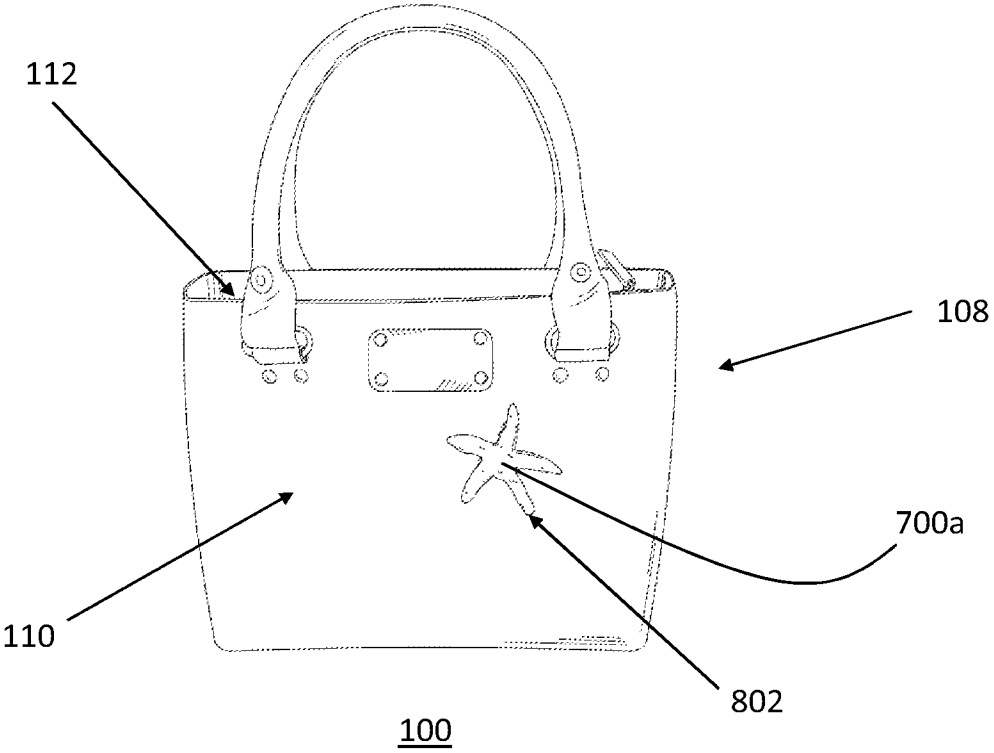
FIGS. 8-14 are elevational views of the interchangeable accessory assembly of FIG. 1, in accordance with various embodiments of the present invention.

Referring now to FIGS. 7-8, the accessory 700, which is another component of the interchangeable accessory assembly 100, is shown in detail. In one embodiment, the accessory 700 may include a coupling side 702 and a decorative side 802 opposite the coupling side 702. The accessory 700 may be made of any material and be any shape and size. In a preferred embodiment, the accessory 700 is an item of jewelry. As used herein, "jewelry" means a decorative arrangement of precious metals, gems, diamonds, polymers, and other materials, whether natural or artificial, used for aesthetic qualities or for personal adornment.

Still referring to FIGS. 7-8, the coupling side 702 may include a second magnetic member 704, which is of an opposite polarity from that of the first magnetic member 400. The accessory 700 is operably configured to be selectively removably mechanically couplable to the anchor shell 102 via the magnetic force between the first magnetic member 400 and the second magnetic member 704. More particularly, the accessory 700 mechanically couples to the exterior side 110 of the fashionable item 108 when the second magnetic member 704 mechanically couples to the first magnetic member 400, which is mechanically coupled to the interior side 112 of the fashionable item 108.

Figure 9:
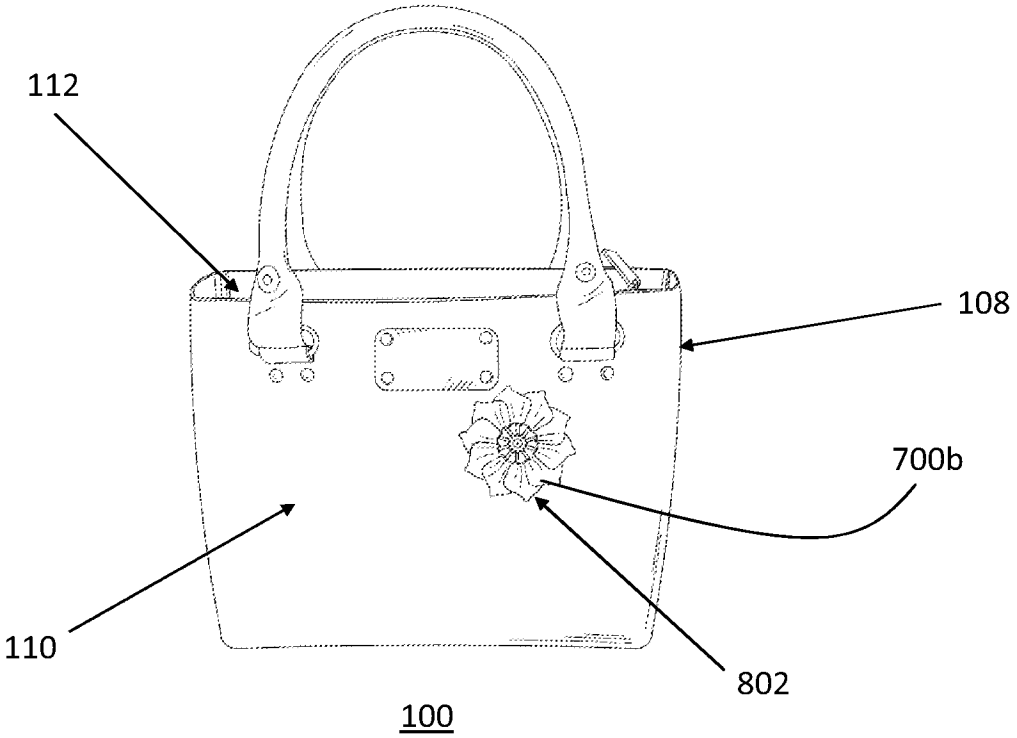
Figure 10:
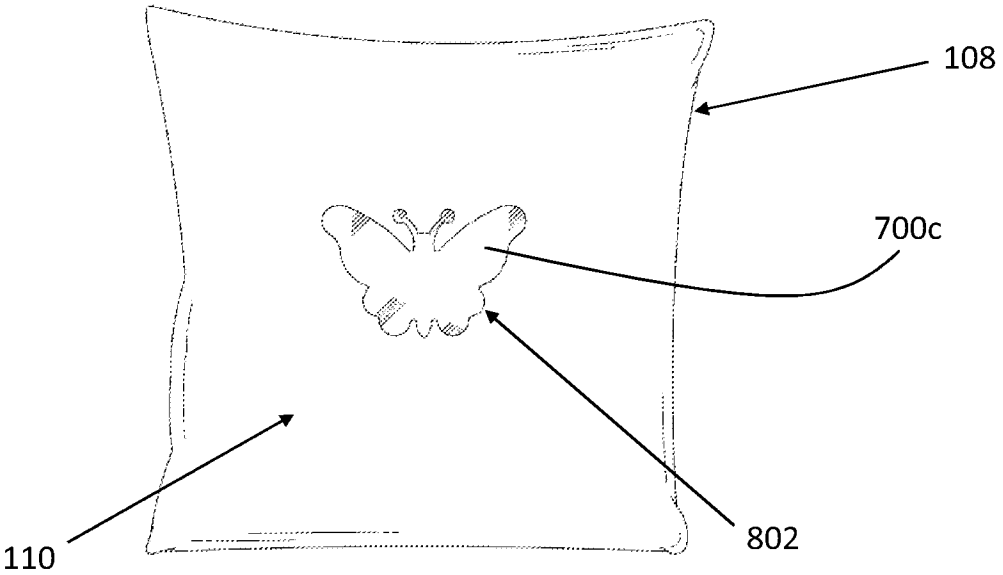
Figure 11:
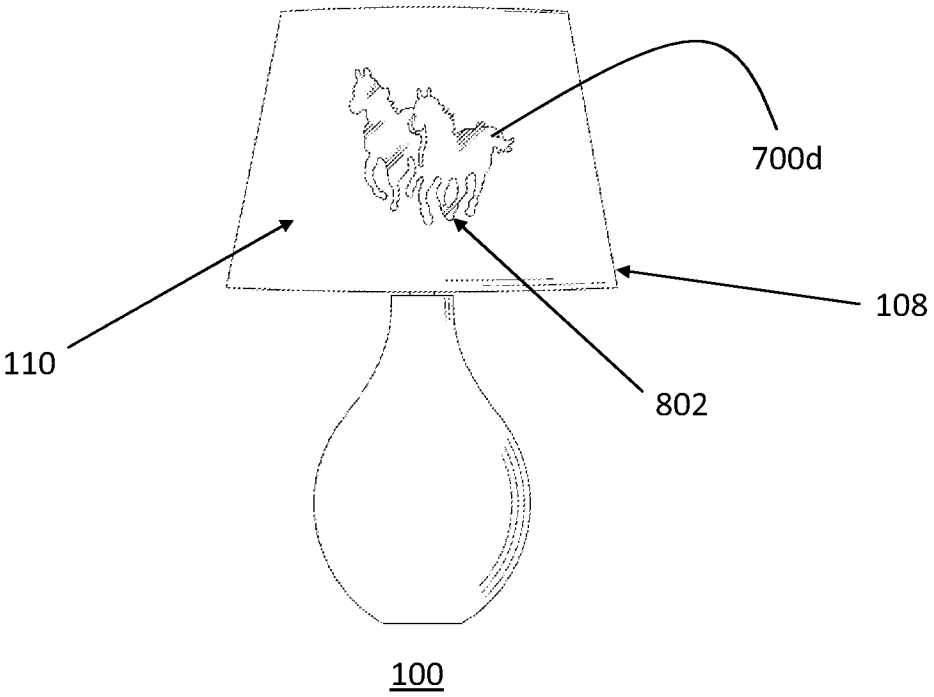
Figure 12:
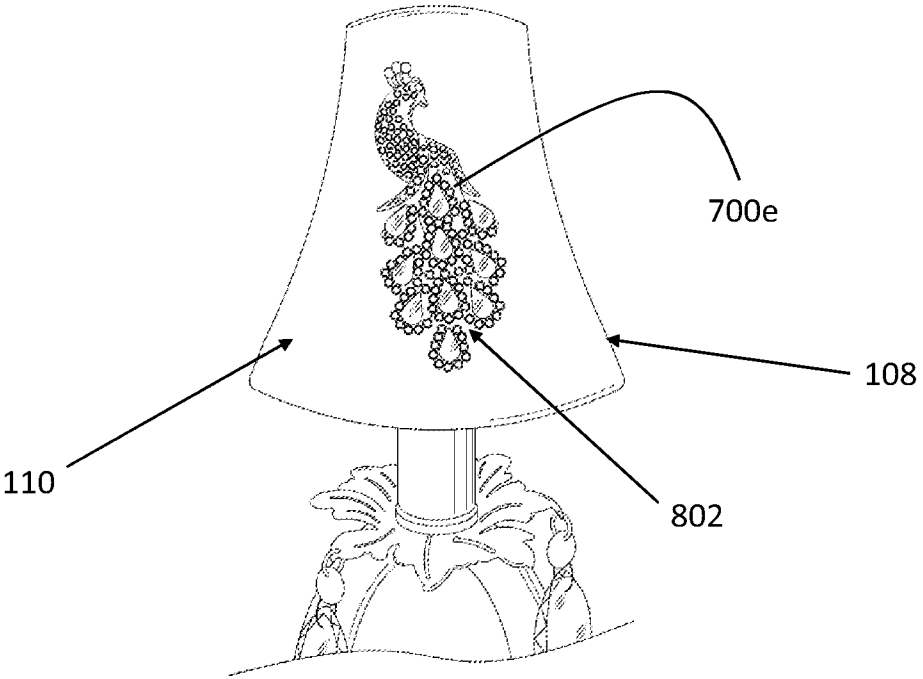
Figure 13:
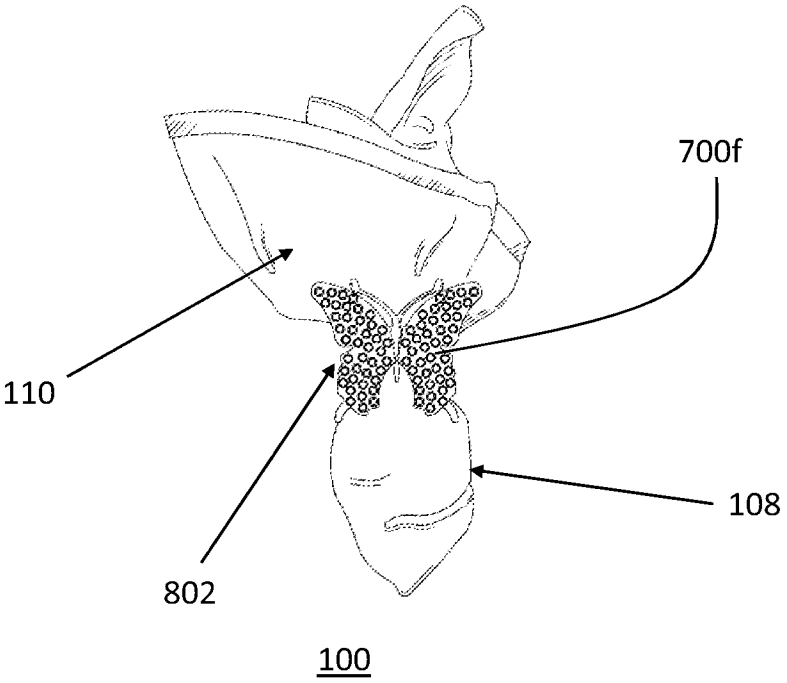
Figure 14:
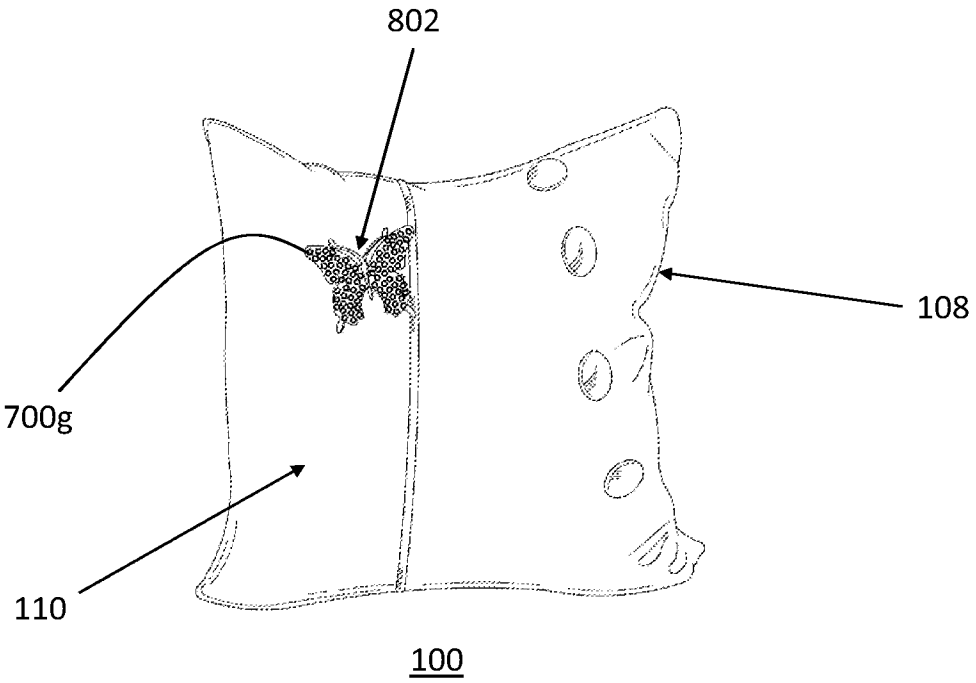

Examples of various accessories 700*a-g* are depicted in FIGS. 8-14; however, it is appreciated that the examples of accessories 700*a-g* are not exclusive, and that the accessory 700 may be of a different material, shape, or size than those depicted in FIGS. 8-14. For example, in one embodiment, the accessory 700*a* may be a bedazzled item, such as a starfish, as depicted in FIG. 8. In another embodiment, the accessory 700*b* may be a flower, either artificial or natural, as depicted in FIG. 9. In a further embodiment, the accessory 700*c* may be a figurine, such as a butterfly, as depicted in FIG. 10. In still a further embodiment, the accessory 700*d* may be an artistic print, such as a horse, as depicted in FIG. 11. In other embodiments, the accessory 700 may be an elaborate piece of artistic jewelry, such as accessories 700*e-g*, as depicted in FIGS. 12-14. As such, the accessory 700 may be interchangeable, advantageously allowing the user to temporarily change the accessory 700 and the overall look of the fashionable item 108 without permanently installing the accessory 700 to the fashionable item 108, or permanently altering the fashionable item 108. For example, a user may interchange accessory 700*a* (shown in FIG. 8) for accessory 700*b* (shown in FIG. 9), and so on.

Figure 15:
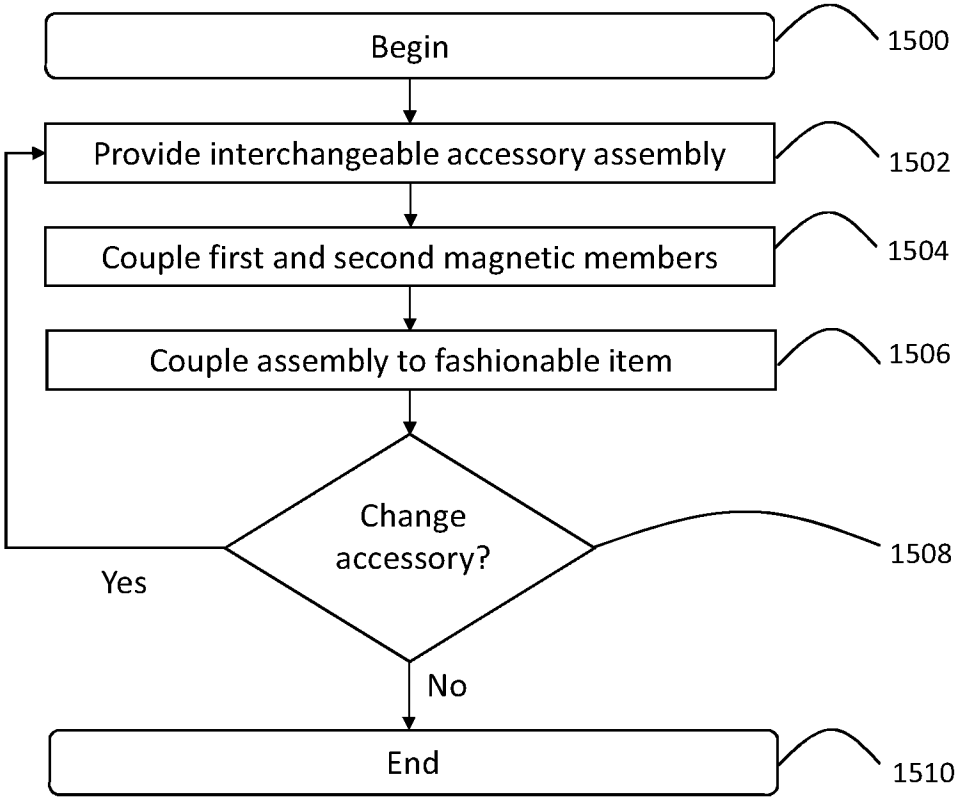
FIG. 15 is a process flow chart of a method of using the interchangeable accessory assembly of FIG. 1, in accordance with one embodiment of the present invention.

FIGS. 1-14 will be described in conjunction with the process flow chart of FIG. 15. Although FIG. 15 shows a specific order of executing the process steps, the order of executing the steps may be changed relative to the order shown in certain embodiments. Also, two or more blocks shown in succession may be executed concurrently or with partial concurrence in some embodiments. Certain steps may be omitted in FIG. 15 for the sake of brevity. In some embodiments, some or all of the process steps included in FIG. 15 can be combined into a single process.

Referring now to FIG. 15, a method of using an interchangeable accessory assembly 100 is described in detail. The method of using the interchangeable accessory assembly 100 begins at step 1500 and proceeds directly to step 1502, in which the interchangeable accessory assembly 100 is provided with the features and configurations described herein above.

The method of using the interchangeable accessory assembly 100 may then continue to step 1504, which includes mechanically coupling the first magnetic member 400 and the second magnetic member 704 via the magnetic force between the first magnetic member 400 and the second magnetic member 704. The method of using the interchangeable accessory assembly 100 may proceed to step 1506, which includes coupling the anchor shell 102 to the interior side 112 of the fashionable item 108, and coupling the accessory 700 to the exterior side 110 of the fashionable item 108, such that the anchor shell 102 magnetically couples to the accessory 700.

The method of using the interchangeable accessory assembly 100 may then proceed to step 1508, in which the accessory 700 may be interchanged. Optionally, the user may choose to keep the original accessory 700 on the fashionable item 108, and the method of using the interchangeable accessory assembly 100 may terminate at step 1510. Alternatively, the user may choose to interchange the accessory 700. For example, the accessory 700*a*, as shown in FIG. 8, may be interchanged for the accessory 700*b*, as shown in FIG. 9. In order to interchange the accessory 700*a* for the accessory 700*b*, steps 1502-1506 may be repeated. Advantageously, the accessory 700 is not permanently installed on the fashionable item.

An interchangeable accessory assembly and method of use has been disclosed that is operably configured to be selectively removably coupled to a fashionable item, the fashionable item having an exterior side opposite an interior side, the interchangeable accessory assembly comprising an anchor shell; a first magnetic member disposed at least partially within the anchor shell; and an accessory selectively removably mechanically couplable to the anchor shell. The anchor shell includes a first tapered portion opposite a second tapered portion, the first tapered portion and the second tapered portion defining a smooth outer surface having a length. The accessory includes a coupling side having a second magnetic member and a decorative side opposite the coupling side. The interchangeable accessory assembly is operably configured such that the first magnetic member and the second magnetic member mechanically couple, and together the first magnetic member and the second magnetic member have a magnetic strength sufficient to couple each of the anchor shell and the accessory to the fashionable item.

What is claimed is:

1. An interchangeable accessory assembly that is operably configured to be selectively removably coupled to a fashionable item, the fashionable item having an exterior side and an interior side opposite the exterior side, the interchangeable accessory assembly comprising:

an anchor shell, the anchor shell having:

a first tapered portion; and a second tapered portion opposite the first tapered portion, the first tapered portion and the second tapered portion defining a smooth outer surface having a length;

a first magnetic member disposed at least partially within the anchor shell; and an accessory selectively removably mechanically couplable to the anchor shell, the accessory:

having a coupling side including a second magnetic member;

having a decorative side opposite the coupling side; and being an item of jewelry;

wherein the first magnetic member mechanically couples to the second magnetic member, the first magnetic member and the second magnetic member together having a magnetic strength sufficient to couple each of the anchor shell and the accessory to the fashionable item.

2. The interchangeable accessory assembly of claim 1 wherein:

the fashionable item is selected from the group consisting of a bag, a purse, a frame, a pillow, a sheet, a blanket, a lampshade, and an item of apparel.

3. The interchangeable accessory assembly of claim 1, wherein:

the first magnetic member is disposed completely within the anchor shell.

4. The interchangeable accessory assembly of claim 1, wherein:

the first magnetic member is disposed substantially flush with an inner surface of the anchor shell.

5. The interchangeable accessory assembly of claim 1, wherein:

the first magnetic member spans at least 70% of the length defined by the first tapered portion and the second tapered portion.

6. The interchangeable accessory assembly of claim 1, further comprising:

at least one indentation defined by the smooth outer surface of the anchor shell.

7. The interchangeable accessory assembly of claim 1, wherein:

the anchor shell is substantially hemispheric in shape.

8. The interchangeable accessory assembly of claim 1, wherein:

the accessory mechanically couples to the exterior side of the fashionable item.

9. The interchangeable accessory assembly of claim 1, wherein:

the anchor shell mechanically couples to the interior side of the fashionable item.

10. The interchangeable accessory assembly of claim 9, wherein:

the smooth outer surface of the anchor shell and the interior side of the fashionable item make a substantially continuous surface area.

11. A method of removably coupling an interchangeable accessory assembly to a fashionable item, the fashionable item having an exterior side and an interior side opposite the exterior side, the method comprising the steps of:

providing:

an anchor shell, the anchor shell having:

a first tapered portion; and a second tapered portion opposite the first tapered portion, the first tapered portion and the second tapered portion defining a smooth outer surface having a length;

a first magnetic member disposed at least partially within the anchor shell; and an accessory selectively removably mechanically couplable to the anchor shell, the accessory having:

a coupling side including a second magnetic member; and a decorative side opposite the coupling side;

mechanically coupling the first magnetic member and the second magnetic member, the first magnetic member and the second magnetic member together having a magnetic strength sufficient to couple each of the anchor shell and the accessory to the fashionable item; and mechanically coupling the anchor shell to the interior side of the fashionable item and the accessory to exterior side of the fashionable item.

12. The method of using the interchangeable accessory assembly of claim 11 further comprising the step of:

interchanging the accessory.

13. The interchangeable accessory assembly of claim 11, wherein:

the accessory is an item of jewelry.

14. An interchangeable accessory assembly that is operably configured to be selectively removably coupled to a fashionable item, the fashionable item having an exterior side and an interior side opposite the exterior side, the interchangeable accessory assembly comprising:

an anchor shell the anchor shell mechanically couples to the interior side of the fashionable item the anchor shell mechanically couples to the interior side of the fashionable item, the anchor shell having:

a first tapered portion; and a second tapered portion opposite the first tapered portion, the first tapered portion and the second tapered portion defining a smooth outer surface having a length;

a first magnetic member disposed at least partially within the anchor shell; and an accessory selectively removably mechanically couplable to the anchor shell, the accessory having:

a coupling side including a second magnetic member; and a decorative side opposite the coupling side;

wherein the first magnetic member mechanically couples to the second magnetic member, the first magnetic member and the second magnetic member together having a magnetic strength sufficient to couple each of the anchor shell and the accessory to the fashionable item and the anchor shell mechanically couples to the interior side of the fashionable item.

15. The interchangeable accessory assembly of claim 14 wherein:

the fashionable item is selected from the group consisting of a bag, a purse, a frame, a pillow, a sheet, a blanket, a lampshade, and an item of apparel.

16. The interchangeable accessory assembly of claim 14, wherein:

the accessory is an item of jewelry.

17. The interchangeable accessory assembly of claim 14, wherein:

the first magnetic member is disposed completely within the anchor shell.

18. The interchangeable accessory assembly of claim 14, wherein:

the first magnetic member is disposed substantially flush with an inner surface of the anchor shell.

19. The interchangeable accessory assembly of claim 14, wherein:

the accessory mechanically couples to the exterior side of the fashionable item.

20. The interchangeable accessory assembly of claim 14, wherein:

the smooth outer surface of the anchor shell and the interior side of the fashionable item make a substantially continuous surface area.

* * * * *